US009593402B1

(12) United States Patent
Thut

(10) Patent No.: US 9,593,402 B1
(45) Date of Patent: Mar. 14, 2017

(54) SYSTEM INCLUDING A PUMP FOR TREATING WIRE IN MOLTEN FLUIDS

(71) Applicant: Bruno Thut, Chagrin Falls, OH (US)

(72) Inventor: Bruno Thut, Chagrin Falls, OH (US)

( * ) Notice: Subject to any disclaimer, the term of this patent is extended or adjusted under 35 U.S.C. 154(b) by 0 days.

(21) Appl. No.: 14/827,748

(22) Filed: Aug. 17, 2015

(51) Int. Cl.
*C21D 9/00* (2006.01)
*C23C 2/10* (2006.01)
*C23C 2/00* (2006.01)

(52) U.S. Cl.
CPC ..... *C23C 2/10* (2013.01); *C23C 2/003* (2013.01)

(58) Field of Classification Search
CPC ..... C21D 9/5732
USPC ..... 266/130, 131, 133
See application file for complete search history.

(56) References Cited

U.S. PATENT DOCUMENTS 3,539,167 A * 11/1970 Ashton ..... C21D 9/5732 118/423
2015/0252807 A1 9/2015 Cooper

FOREIGN PATENT DOCUMENTS

JP 06346152 A * 12/1994

* cited by examiner

*Primary Examiner* — Scott Kastler
(74) *Attorney, Agent, or Firm* — Abel Law Group, LLP

(57) ABSTRACT

A system for treating wire includes an elongated vessel that contains a molten fluid. A pump is disposed in the molten fluid in the vessel. The pump includes an elongated discharge conduit extending for at least a portion of the length of the vessel. Conveyance structure enables the wire to be conveyed through the molten fluid. Operation of the pump enables a temperature of the molten fluid in the vessel to be changed. The wire is heat treated as a result of passing through the molten fluid.

29 Claims, 5 Drawing Sheets

SYSTEM INCLUDING A PUMP FOR TREATING WIRE IN MOLTEN FLUIDS

TECHNICAL FIELD

This pertains to the field of systems for treating wire in molten fluids, particularly molten lead.

BACKGROUND

In the course of heat treating wire it is sometimes beneficial to treat the wire in a molten fluid bath. When a molten lead bath is employed for annealing steel wire, elaborate heat control means are employed to maintain a proper lead temperature throughout the length of the bath. The lead bath is contained in an elongated trough. The wire that enters the bath is very hot and the bath quickly heats up as a result of the wire passing through it. One known method of attempting to maintain the lead bath temperature is directing fans at the warmer sections of the bath in an effort to cool them. This method can be inefficient for a number of reasons. Aiming the fan nozzles at specific hot spots is difficult. Even if the nozzles are directed at a specific hot spot, the spot may shift. Depending on the size of the bath, a large number of fans may be required which causes a great deal of power to be used to cool the bath.

Therefore it is desired that another method be used to be able to control temperature in the molten fluid bath.

Technical Summary

A first aspect of the disclosure features a system for heat treating metal wire. The system comprises a vessel that contains a molten fluid, a pump for circulating the molten fluid in the vessel, and a device that enables the wire to move through the molten fluid of the vessel. Reference to a wire in this disclosure is intended to cover any elongated article requiring treatment in a bath, including bundles of wires, braided wire and cable. The wire is typically made of metal. One example material of the metal wire is steel. The term "heat treating" as used in this disclosure means, for example, at least one of annealing, patenting, hardening, quenching and tempering, wherein the temperature of the wire is modified, that is, increased or decreased.

More specifically, in the first aspect of the disclosure the vessel is an elongated trough having a ratio of length to width of at least 5:1. The pump in the first aspect generally includes a motor, a pump shaft, a base that is submerged in the molten fluid, and an impeller. The pump shaft is connected to and driven by the motor. The base includes an impeller chamber, at least one inlet port, and at least one outlet port. The impeller is connected to the pump shaft and is rotatably disposed in the impeller chamber. An elongated discharge conduit is attached in alignment with the outlet of the base and extends outwardly from the base. The pump circulates the molten fluid in the vessel cooling the molten fluid in regions of the vessel.

Referring to further specific features of the first aspect, the molten fluid may be molten lead. The wire may be comprised of steel. The molten fluid may be maintained at a temperature permitting the wire to be heat treated (e.g., at least one of annealed or quenched) as a result of moving through the molten fluid. The pump may be offset from a centerline of the trough, for example, adjacent to an elongated edge of the trough. This facilitates passing wires through the trough without the pump being an obstruction.

Multiple spaced apart wires may be passed at the same time through the trough and heat treated simultaneously.

In one specific variation, the discharge conduit may extend for at least 50% of the length of the trough. In another specific variation, the discharge conduit may extend for at least 75% of the length of the trough. In yet another specific variation, the discharge conduit may extend for at least 90% of the length of the trough. The length of the discharge conduit is measured outward from an external surface of the base (i.e., in a case of using two discharge conduit sections both sections would be included in the length).

Any of the features of the Detailed Description below can be combined with any of the specific features applicable to the first aspect described above, in any combination.

A second aspect of the disclosure employs an elongated vessel (e.g., having a ratio of length to width of at least 5:1). Any suitable pump can be employed in the second aspect, for example, a pump as described in the first embodiment, any pump sold by High Temperature Systems, Inc. or patented by inventor Bruno Thut. An elongated discharge conduit is attached to and extends outwardly from the pump. Conveyance structure enables the wire to be conveyed through the molten fluid. Operation of the pump enables the temperature of the molten fluid in the vessel to be changed (e.g., cooled) and the wire is heat treated as a result of passing through the (e.g., cooled) molten fluid.

Referring to specific features of the second aspect, the molten fluid can be molten lead. The wire can be comprised of steel. The vessel can have a ratio of length to width of at least 5:1 and the elongated discharge conduit can extend for at least 50% of the length of the vessel. The conveyance structure can include sets of rollers that enable the wire to be conveyed through the molten fluid; at least some of the rollers can be disposed in the molten fluid.

One advantage is that in this disclosure a molten fluid hot spot is maintained at about the same temperature as a molten fluid hot spot temperature in a conventional bath without using the pump but which employs conventional cooling means (e.g., fans). Alternatively, in this disclosure a molten fluid hot spot is maintained at a cooler temperature than a molten fluid hot spot temperature in a conventional bath without using the pump but which employs the conventional cooling means. For example, this cooler hot spot temperature is at least 50 degrees F. less than a conventional hot spot temperature, in particular, at least 20 degrees F. less than a conventional hot spot temperature, in particular, at least 10 degrees F. less than a conventional hot spot temperature. A hot spot temperature as used in this disclosure means a temperature of the molten fluid in the bath which is at a peak temperature of the molten fluid in the bath. A hot spot may reside in the bath near a location where the hot wire enters the bath. Because an elongated bath is used, the molten fluid will be cooler and more viscous or dense at a location remote from the hot spot. Moving cooler molten fluid to the hot spot with the pump having an elongated discharge conduit facilitates cooling the hot spot. General circulation may also cool the hot spot and may result in a more uniform temperature throughout the bath.

Any of the features described above in connection with the first aspect, and features of the Detailed Description below, can apply to the specific features applicable to the second aspect described above, in any combination.

A third aspect of the disclosure is directed to a method of treating a wire wherein the wire is conveyed through molten fluid contained in the vessel. The molten fluid is moved in the vessel so as to change a temperature (e.g., cool) the molten fluid in the vessel. The molten fluid is moved using a pump submerged in the molten fluid, the pump including the elongated discharge conduit in the vessel. The wire is heat treated as a result of moving through the (e.g., cooled) molten fluid.

Referring to specific features of the third aspect of the disclosure, the elongated discharge conduit can extend from the pump in a direction opposite a direction in which the wire is being conveyed. In another feature, the molten fluid can be molten lead. In another feature, rollers can be used to convey the wire through the molten fluid.

Still further, the vessel can be a trough having a ratio of length to width of at least 5:1. Another feature is that the discharge conduit can extend for at least 50% of the length of the vessel, in particular, for at least 75% of the length of the vessel, more particularly, for at least 90% of the length of the vessel.

Further features are that the pump can be located adjacent an elongated sidewall of the trough. Another feature is that the method moves with the pump cooler molten fluid to a hot spot of the molten fluid so as to carry out the cooling of the molten fluid. Still further, the hot spot can be near an entry location of the wire into the molten fluid contained in the vessel and the cooler molten fluid is remote from the entry location, comprising positioning an inlet of the pump near the location of the cooler molten fluid and positioning an outlet of the discharge conduit so as to discharge the cooler molten fluid into the hot spot of the molten fluid. Another feature is that the pump operates intermittently. Another feature is that the pump can circulate the molten fluid in the vessel. The pump could operate continuously resulting in general circulation that may result in a more uniform temperature throughout the bath.

In another feature, a temperature sensor can be placed near the wire entry location and this can be connected to a controller (e.g., a PLC or other suitable controller known in the art). A desired temperature range is programmed into the controller and the controller activates the pump to discharge cooler molten fluid into the hot spot when the temperature sensor senses a temperature outside the desired temperature range. In yet another feature the controller deactivates the pump when the temperature sensor senses a temperature in the desired temperature range.

The use of the pump to achieve cooling in the present system is advantageous in that it avoids the problems of the prior art which use energy intensive and inefficient fans for cooling. The present system and method require no use of fans for cooling. In addition, the present system would not have occurred to one skilled in the art for use with viscous or dense fluids, for example, molten lead. It would be expected to be difficult to move such viscous or dense molten fluids in the vessel. The present system and method avoid this problem using the pump with elongated discharge conduit. Moreover, the condition of the molten fluid (e.g., temperature, density and/or viscosity) can be controlled and adjusted in the present system and method, by carrying out at least one of the following: changing the rotational speed of the impeller, using different impellers, changing the length of the discharge conduit, changing a position and number of outlet openings in the discharge conduit, and by adjusting when the pump is operational. The present system also permits variations in design such as different shaped vessels, which may present advantages in production. Therefore, the present system and method provide a unique, energy efficient solution for use in a process for heat treating wire.

Many additional features, advantages, and a fuller understanding of the invention will be had from the accompanying drawings and the detailed description that follows. It should be understood that the above Technical Summary describes the disclosure in broad terms while the following Detailed Description describes the disclosure more narrowly and presents specific embodiments that should not be construed as necessary limitations of the invention as defined in the claims.

DETAILED DESCRIPTION

Figure 1:
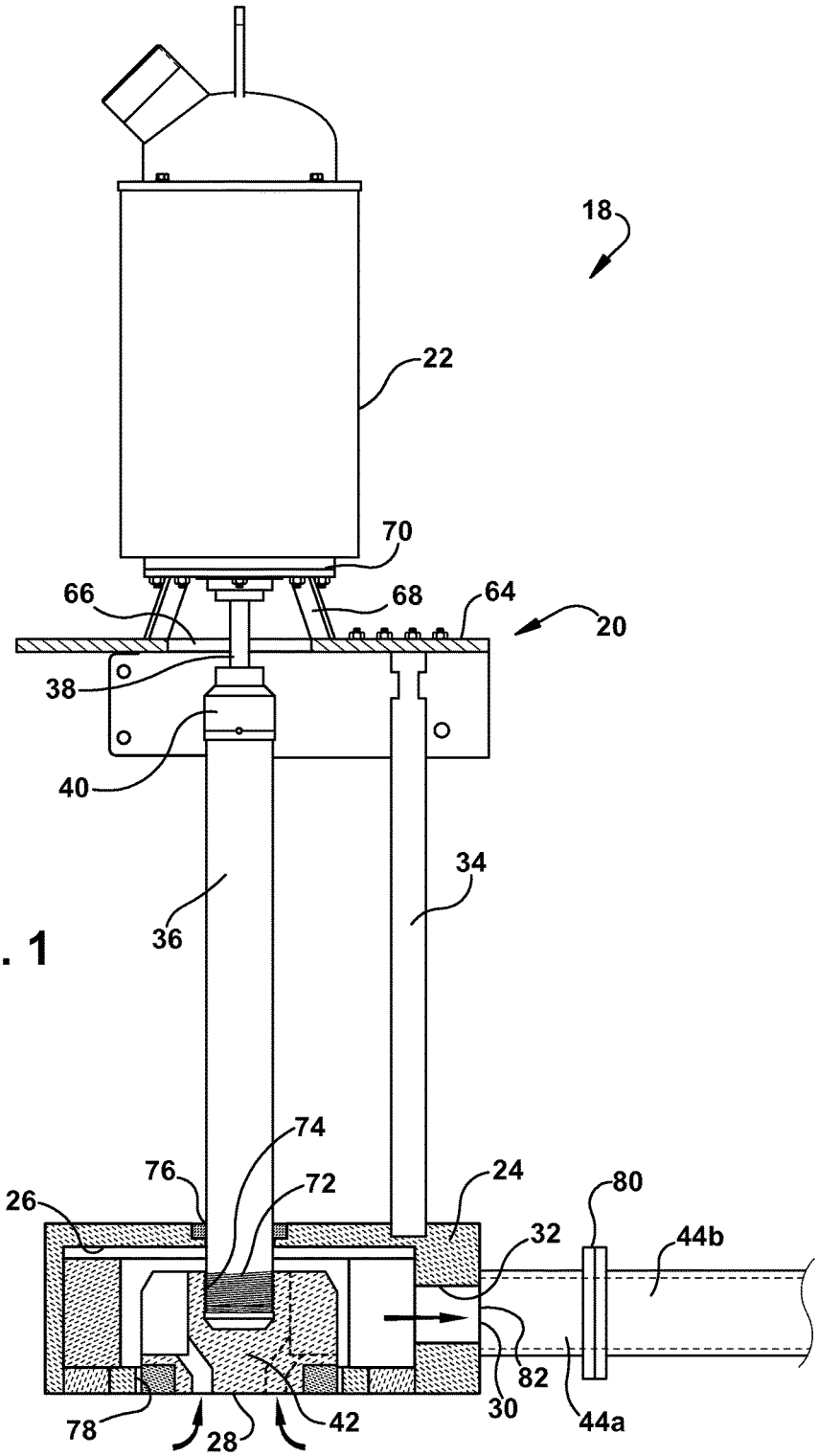
FIG. 1 is a vertical cross-sectional view of a pump constructed according to the present disclosure.

This disclosure features a system 10 for heat treating metal wire 12. A vessel 114 is filled with molten fluid 16 to create a bath for treating the wire 12. A pump 18 for pumping the molten fluid 16 is placed in the vessel 114. A motor mount 20 is disposed above the molten fluid 16 contained in the vessel 114. A motor 22 is supported by the motor mount 20. Submerged in the molten fluid 16 is a base 24 that includes an impeller chamber 26. A molten fluid inlet opening 28 is disposed in the impeller chamber 26 and a molten metal outlet in the form of a discharge passageway 32 extends from the impeller chamber 26 to outlet orifice 30 at an exterior surface of the base 24. The base 24 is submerged in the molten fluid 16. The base 24 is connected to the motor mount 20 by support posts 34 that are attached to the base 24 and attached to the motor mount 20 as known in the art. A pump shaft 36 is connected to a drive shaft 38 of the motor 22 at one end via a coupling 40 as known in the art. An impeller 42 is connected to the other end of the pump shaft 36 and is rotatable in the impeller chamber 26. The discharge passageway 32 that is inside the base is in fluid communication with an elongated discharge conduit 44 which extends outwardly from the base 24. The elongated discharge conduit 44 extends for a distance at least equal to the length of the base 24. A conveyance structure 45 is used in the system 10 for directing the wire 12 through the molten fluid 16 of the vessel 114. It may be possible to direct the wires into the trough along a horizontal reference line below the bath surface, but this would require seals in the vessel that would prevent molten fluid from leaving the vessel.

Figure 2:
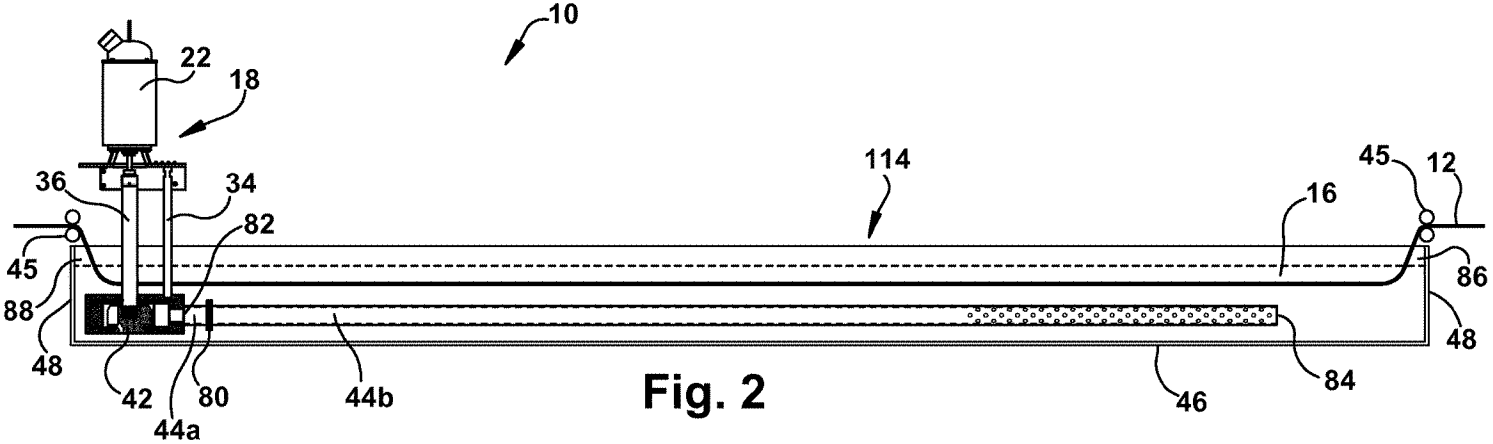
FIG. 2 is a vertical cross-sectional view of a system made according to the present disclosure.
Figure 3:
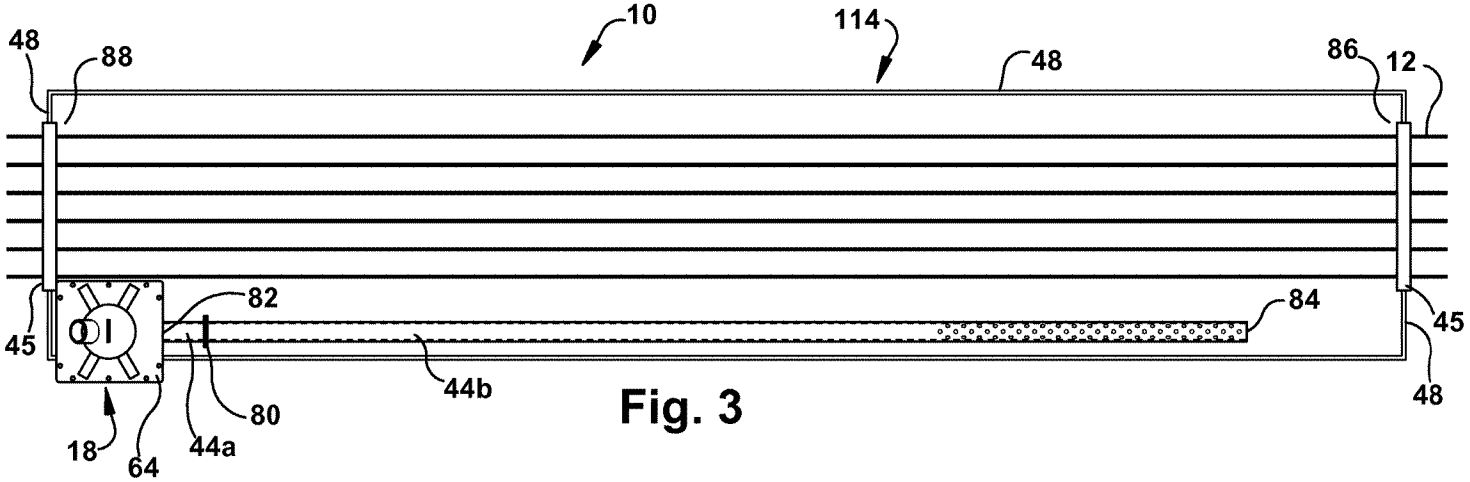
FIG. 3 is a top plan view of the system as shown in FIG. 2.
Figure 4:
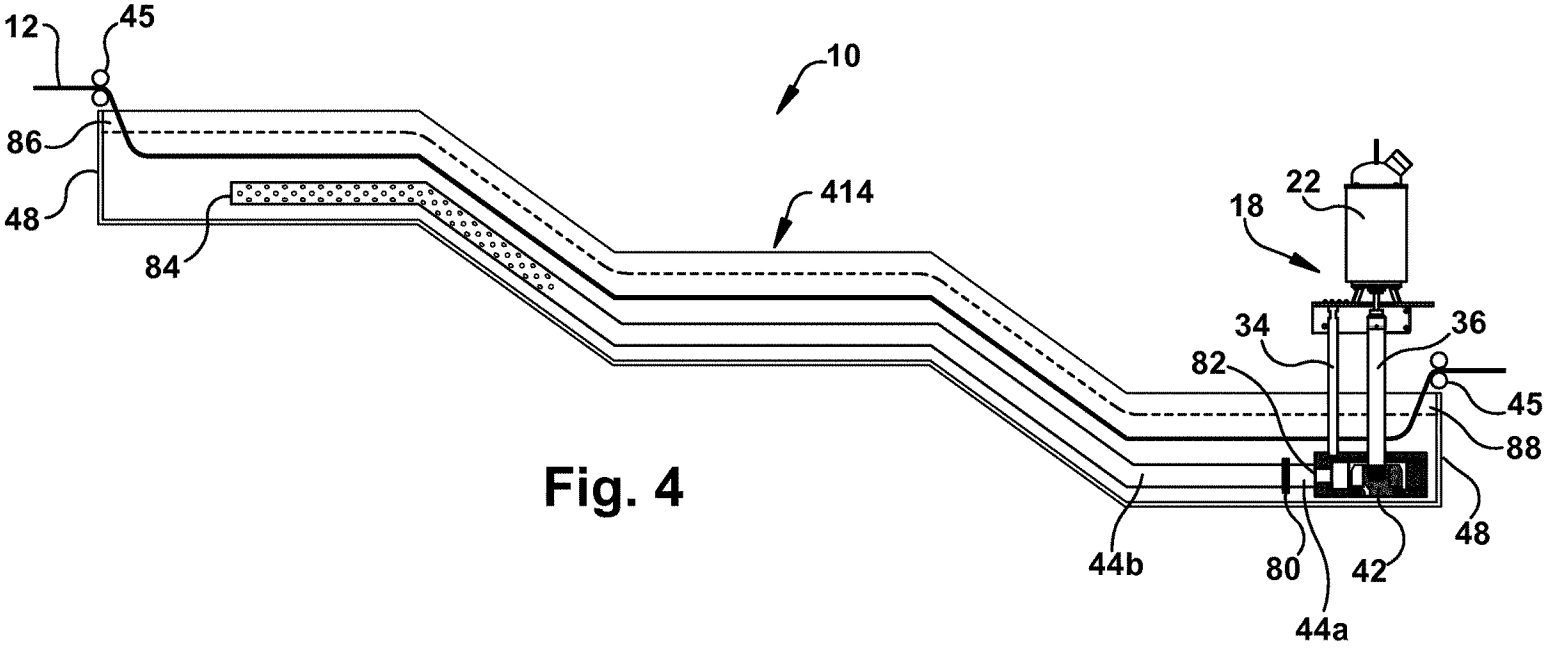
FIG. 4 is a vertical cross-sectional view of a system made according to the present disclosure.
Figure 5:
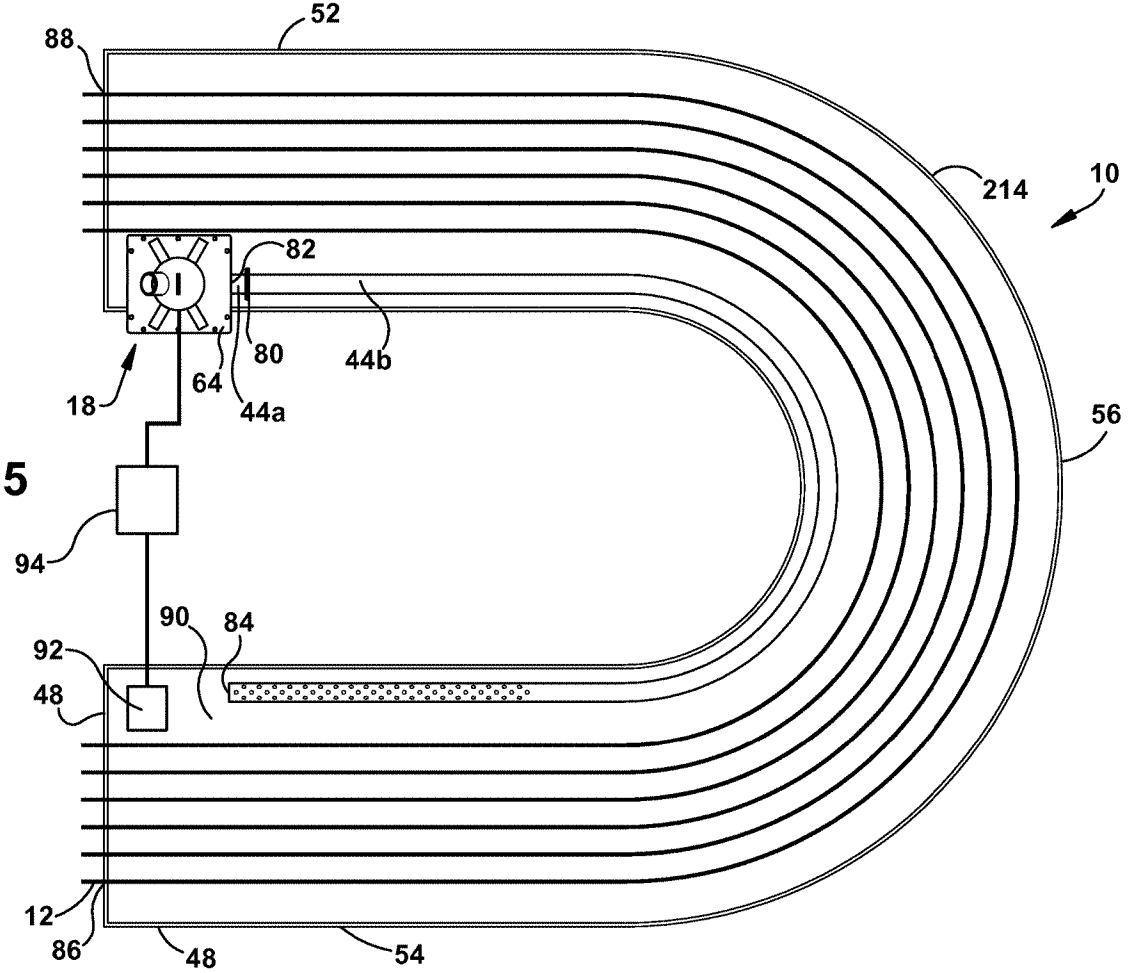
FIGS. 5-7 are top plan views of systems made according to the present disclosure which employ vessels having different shapes.
Figure 6:
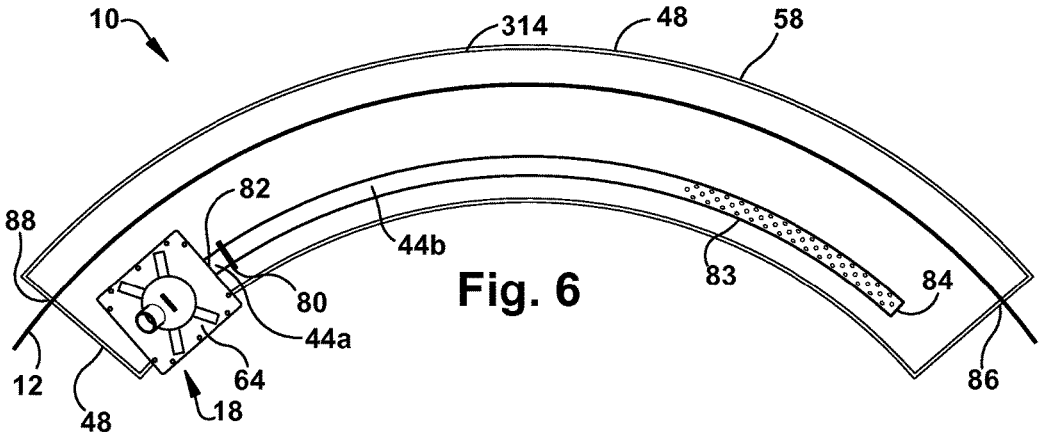
Figure 7:
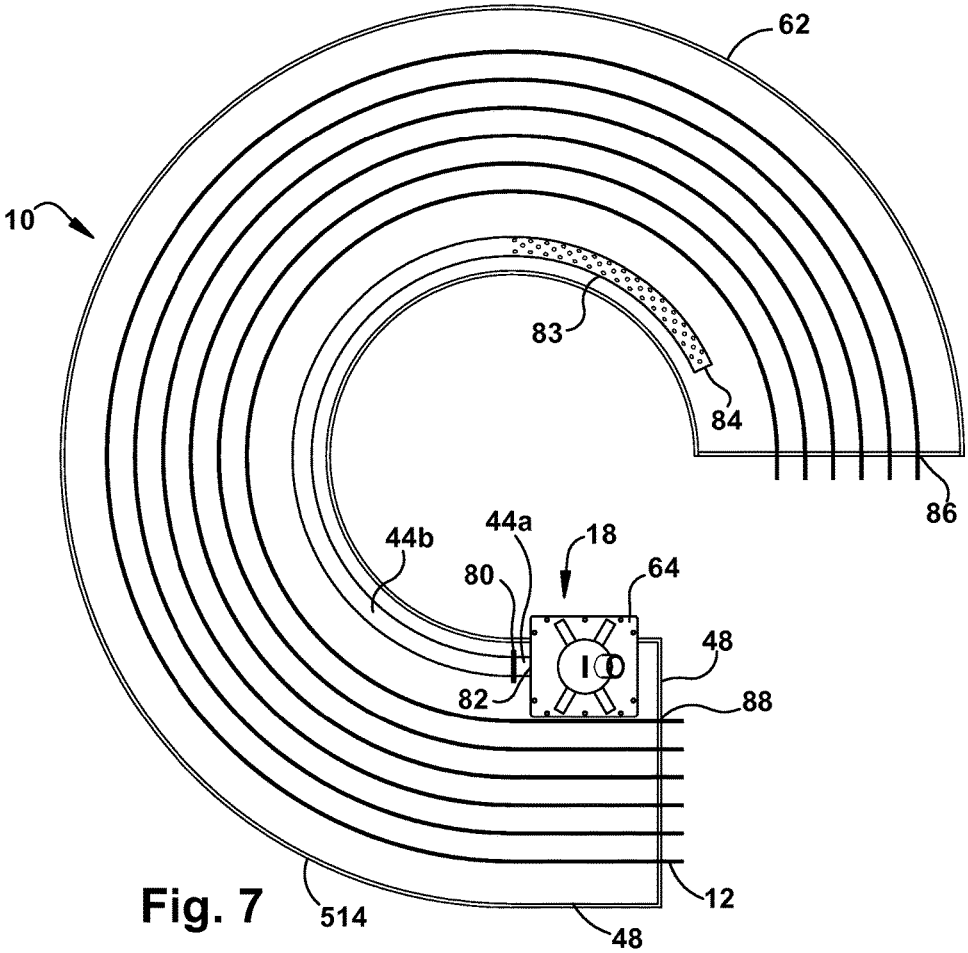

The vessel 114 is partly filled with molten lead or other suitable molten fluid. The vessel 114 can comprise a substantially flat floor 46 and opposing sidewalls 48. One embodiment of the vessel 114, seen in FIGS. 2 and 3, comprises an elongated trough 50 with a length to width ratio of at least 5:1. The vessel 114 can have various shapes and configurations. Another embodiment of the vessel 214 comprises two parallel substantially straight, trough sections 52, 54 connected by a substantially curved trough section 56 as shown in FIG. 5. A further embodiment of the vessel comprises a partially curved trough 314 as shown in FIG. 6. Another embodiment comprises a vertically stepped trough 414 as shown in FIG. 4. In this design, the pump is located at the lowest elevation remote from the wire entry location while the wire inlet location is located at a highest elevation. This may enable the molten fluid to move by gravity down the elevation causing some inherent circulation. The elevation change has been exaggerated in this figure and may only be on the order of a few to several inches. A further embodiment of the vessel comprises a trough 514 that is substantially curved along its entire length 62 as shown in FIG. 7. The extent by which the wire can be curved, and the desired layout of the wire heat treating station, may affect which of the trough configurations is used.

The motor mount 20 can have various configurations and in this particular design comprises a flat mounting plate 64. A hanger eye may be attached to the motor mount 20 or to the motor 22. A hook (not pictured) on the end of a cable (not pictured) or the like is inserted into the hanger eye to hoist the pump 18 in and out of the vessel 14. The motor 22 is an air motor, electric motor or the like, and is mounted onto the motor mount 20. The motor mount plate 20 may optionally also include brackets 68 for supporting the motor 22 on an adaptor plate 70 above the flat motor mount plate 64 of the motor mount 20. One or both of the adaptor plate 70 and the flat mounting plate 64 include openings 66 for the drive shaft 38, a coupling and/or the pump shaft 36. The upper end portion of the pump shaft 36 is coupled to the drive shaft 38 of the motor 22 using a detachable coupling 40 as known in the art, which rotates the impeller 42 in the impeller chamber 26. The coupling may be above or below the motor mount plate 64. An optional shaft sleeve (not pictured) can surround the shaft between the motor mount 20 and the base 24 as known in the art. In the example pump 18 design shown in the drawings no shaft sleeve is used. Because of the density of molten metal, especially molten lead, the motor 22 has as an example, a minimum power of 3-5 hp. The pump is adapted to accommodate pieces of metal being disposed in the molten fluid such as dislodged metal pieces of wire.

The impeller 42 is attached to one end portion of the pump shaft 36 such as by engagement of exterior threads 72 formed on the pump shaft 36 with corresponding interior threads 74 formed in the impeller 42. However, any connection between the pump shaft 36 and the impeller 42, such a key way or pin arrangement, or the like, may be used. Any suitable impeller may be used in the embodiment of the present system 10 including a squirrel cage impeller or a PENTELLER® brand impeller with vanes and a perforated impeller base or an imperforate impeller base as manufactured by High Temperature Systems Inc. The impeller shown in FIG. 1 has perforations in the impeller base so that molten metal can enter the base through the perforations of the rotating impeller. The impeller 42 and/or pump shaft 36 can be made from heat-resistant material such as graphite. The pump 18, including the base 24, can be machined from steel.

The submerged base 24 is raised in a well known manner so that the base 24 does not rest on the floor 46 of the vessel 14. The discharge passageway 32 is preferably tangential to the impeller chamber 26 as seen in a top view, as is known in the art. Openings are formed in upper and lower surfaces 76, 78 of the base 24 and the upper opening 76 receives the pump shaft 36. An opening (not pictured) can surround the upper base inlet opening and receive the optional shaft sleeve. The upper and lower openings 76, 78 are concentric to one another relative to the central rotational axis A of the impeller 42.

The disclosure is not limited to any particular pump 18 construction. It should be appreciated by one of ordinary skill in the art that any pump design manufactured by High Temperature Systems Inc. or patented by inventor Bruno Thut, may be suitable for use in the present disclosure. In this regard, upper and lower concentric openings can be formed in upper and lower surfaces 76, 78 of the base 24 and can be large enough to enable the impeller 42 to pass through them. The upper such opening can be an inlet opening into the base with the lower opening being optionally usable as an inlet opening, permitting the pump to be a top feed, bottom feed, or top and bottom feed pump. In FIG. 1, a shoulder is formed in the base 24 around the upper and lower base openings. Upper and lower bearing rings can be cemented to the respective upper and lower shoulders as known in the art.

The optional shaft sleeve can be cemented in place on the upper shoulder and the base 24 can include another surface for supporting the upper bearing ring as known in the art. The optional shaft sleeve can contain multiple inlet openings or a gap adjacent to the base 24 such as if gas is to be inlet down the shaft sleeve as in the case of the Poseidon™ pump manufactured by High Temperature Systems, Inc.

A lower end of the support post 34 is cemented in a socket or otherwise mechanically fastened to the base 24 and the upper end of the support post 34 is mounted to the motor mounting plate 64 as in quick release sockets, both as known in the art.

The internal discharge passageway 32 of the base 24 is in fluid communication with the external elongated discharge conduit 44. The elongated discharge conduit 44 may comprise two sections, 44*a*, 44*b*. The first discharge conduit section 44*a* is fastened to the base as by welding and is fastened to the second elongated discharge conduit section 44*b* such as by a bolted flange connection 80. However, any suitable connection 80 between the second elongated discharge conduit 44*b* and the first discharge conduit 44*a* may be used. The discharge conduit sections 44*a* and 44*b* are exterior to the base. The elongated discharge conduit 44 extends in a shape configured to the embodiment of the vessel 114, i.e., it may be straight and/or curved as shown in FIGS. 2-7. The elongated discharge conduit 44 may extend from the connection to the base 24 for any percentage of the length of the vessel 114. In particular, the elongated discharge conduit 44 extends from the connection to the base 24 for at least 50% of the length of the vessel 114. In all aspects of the disclosure the elongated discharge conduit 44 may only contain a single inlet port 82 (e.g., at the entrance to discharge conduit 44*a*) and a single outlet port 84 at the opposing end of the conduit 44*b*, or it may contain a number of outlet openings 83 (e.g., see FIG. 6) along some length of the conduit in addition to the inlet and outlet ports 82, 84. The elongated discharge conduit 44 is prevented from resting on the floor 46 of the vessel 14 such as by brackets (not pictured); however, any suitable means may be used for this purpose.

The wire 12 is conveyed for treatment in the molten fluid 16 and through the vessel 14 such as by rollers. However, any suitable conveyance device for directing the wire 12 through the molten fluid 16 may be used. The conveyance device may change the path of the wire through the vessel vertically and/or horizontally. Rollers or other aspects of the conveyance device may be external to the molten fluid and optionally inside the molten fluid. The illustration of the rollers in the drawings is only schematic for aiding understanding. It should be appreciated that the rollers could be placed at various other locations and additional roller sets may be used, other than what is shown.

A method of treating wire 12 includes the following steps. The metal wire 12 is positioned and directed by the wire conveyance device. That is, the path of the wire changes from horizontal, downward into the vessel, along the vessel under the bath surface, then upward out of the vessel to a horizontal path again. Of course, the entry and exit paths when the wire is out of the vessel need not be horizontal. The metal wire 12 enters the vessel 14 at a wire entry point 86 and exits the vessel 114 at a wire exit point 88. The method further includes the step of conveying the metal wire 12 along a conveyance path in the vessel 114. It should be appreciated that various conveyance devices that are different than the rollers shown in the drawings, for directing the wire into and from the bath, and possibly within the bath, may be suitable for use in the present system.

The method further includes the step of connecting the discharge conduit 44*a* to the base 24 in alignment with the discharge orifice 30. The inlet opening 28, the discharge passageway 32, and the elongated discharge conduit 44 of the base 24 are submerged in the molten fluid 16. The pump shaft 36 is driven by operating the motor 22, which rotates the impeller 42 in the impeller chamber 26. Rotation of the impeller 42 causes the molten fluid 16 to flow into the impeller chamber 26 through the inlet opening 28 and from the impeller chamber 26 into the discharge passageway 32 and further through outlet orifice 30 into the inlet orifice 82 of the connected discharge conduit section 44*a* to the elongated discharge conduit 44*b* from which it enters the vessel 14 through discharge conduit outlet 84 and/or through openings 83. The impeller 42 rotates at any suitable rotational speed.

As further illustrated, the pump 18 may be placed adjacent to the wire exit point and the elongated discharge conduit 44*b* may extend from the base 24 in a direction toward the wire entry point. On the other hand, the pump 18 might be placed adjacent to the wire entry point with the conduit extending toward the wire exit point. The pump 18 may be placed adjacent to the sidewall 48 with the discharge conduit 44 extending adjacent to the same sidewall 48 so as to not impede the conveyance path. However, any suitable placement of the pump 18 and conduit may be used.

The method optionally includes the step of monitoring the temperature of the molten fluid 16 and maintaining the temperature in a range to allow treatment of the wire 12. A particular example temperature of the molten fluid 16 is in a range between 900-1000 degrees Fahrenheit; however any suitable temperature for treating the wire 12 may be used. A temperature at the wire entry/or and exit locations may be monitored and regulated. For example, the pump 18 may pump cooler molten lead so as to enter the inlet opening 28 of the base 24 near the wire exit end portion of the vessel, or other location in the vessel, to travel along the elongated discharge conduit 44*b* and to discharge from the elongated discharge conduit 44*b* through outlet 84 and/or outlets 83 at a region near a hot spot 90 in the bath, for example, near the wire entry location 86. A temperature sensor 92 may be placed at the hot spot 90 and may be connected to the pump 18 via connection with a PLC 94. A desired temperature range for the hot spot 90 may be selected and programmed into the PLC. The pump 18 may be placed in the vessel such that the molten inlet opening 28 would be placed in the cooler molten fluid and the outlet port 84 of the elongated discharge conduit 44 would be located adjacent to the hot spot 90. The PLC 94 may be programmed to activate the pump 18 to pump the cooler molten fluid to the hot spot 90 until the hot spot 90 is within the desired temperature range. The PLC 94 may then deactivate the pump 18. On the other hand, the PLC may operate to control or monitor overall temperature in the bath rather than at a hot spot.

The molten fluid 16 exits the outlet port 84 of the conduit at a pressure sufficient to mix with the molten fluid 16 in the vessel 14, for example to cause circulation of the molten fluid 16 in the vessel 14. This mixing can cause a mixed molten fluid 16 to flow in a direction opposite a path of the molten fluid 16 exiting the outlet port 84 of the elongated discharge conduit 44 (e.g., from the wire inlet location toward the wire outlet location). The mixed molten fluid 16 in the vessel 14 can flow in a direction toward the inlet opening 28 of the base 24. The pump may operate intermittently or continuously; this may permit some temperature variation in the bath or achieve a relatively uniform bath temperature compared to the prior art system, respectively. No fans need to be employed in the system of the present disclosure.

Many modifications and variations of the disclosed subject matter will be apparent to those of ordinary skill in the art in light of the foregoing disclosure. Therefore, it is to be understood that, within the scope of the appended claims, the invention can be practiced otherwise than has been specifically shown and described.

What is claimed is:

1. A system for treating wire, comprising:

an elongated vessel that contains a molten fluid;

a pump disposed in the molten fluid in said vessel, wherein said pump includes an elongated conduit extending for at least a portion of the length of said vessel, said elongated conduit including an inlet at a location of cooler molten fluid in said vessel, wherein a hot spot is near a wire entry location of wire into the molten fluid contained in said vessel, the cooler molten fluid being remote from said wire entry location, a pump outlet being positioned so as to discharge the cooler molten fluid into the hot spot of the molten fluid; and conveyance structure that enables the wire to be conveyed through the molten fluid;

wherein operation of said pump enables the hot spot to be cooled by the cooler molten fluid in said vessel and the wire is heat treated as a result of passing through the molten fluid.

2. The system for treating wire of claim 1 wherein said pump include a motor, a pump shaft driven by said motor, a base including an impeller chamber, an impeller connected to said pump shaft and rotatably disposed in said impeller chamber, said base including at least one inlet and at least one said pump outlet, said elongated conduit in fluid communication with said discharge impeller chamber.

3. The system of claim 2 wherein said conveyance structure includes rollers.

4. The system of claim 2 wherein said molten fluid is maintained at a temperature permitting said wire to be annealed as a result of moving through the molten fluid.

5. The system of claim 2 wherein said vessel is an elongated trough having a ratio of length to width of at least 5:1.

6. The system of claim 5 wherein said elongated conduit extends for at least 50% of the length of said trough.

7. The system of claim 5 wherein said elongated conduit extends for at least 75% of the length of said trough.

8. The system of claim 5 wherein said elongated conduit extends for at least 90% of the length of said trough.

9. The system of claim 5 wherein said pump is located adjacent an elongated sidewall of said trough.

10. The system of claim 1 wherein the molten fluid is molten lead.

11. The system of claim 1 wherein said wire is comprised of steel.

12. The system of claim 1 wherein said vessel has a ratio of length to width of at least 5:1 and said elongated conduit extends for at least 50% of the length of said vessel.

13. A method for treating metal wire comprising:

conveying the wire through molten fluid contained in a vessel;

moving the molten fluid in said vessel using a pump submerged in the molten fluid, said pump including an elongated conduit in said vessel, wherein the molten fluid includes a hot spot;

moving cooler molten fluid in said vessel with said pump to the hot spot of the molten fluid so as to cool the hot spot; and heat treating said wire as a result of moving through the molten fluid.

14. The method of claim 13 wherein said elongated conduit extends from said pump and fluid moves in said elongated conduit in a direction opposite to a direction in which the wire is being conveyed in said molten fluid.

15. The method of claim 13 wherein the molten fluid is molten lead.

16. The method of claim 13 wherein rollers are used to convey the wire through the molten fluid.

17. The method of claim 13 wherein said vessel is a trough having a ratio of length to width of at least 5:1.

18. The method of claim 17 wherein said elongated conduit extends for at least 50% of the length of said trough.

19. The method of claim 17 wherein said elongated conduit extends for at least 75% of the length of said trough.

20. The method of claim 17 wherein said elongated conduit extends for at least 90% of the length of said trough.

21. The method of claim 17 wherein said pump is located adjacent an elongated sidewall of the trough.

22. The method of claim 13 wherein said hot spot is near a wire entry location of the wire into the molten fluid contained in said vessel and the cooler molten fluid is remote from said entry location, comprising positioning an inlet of the pump near the location of the cooler molten fluid and positioning an outlet of the pump so as to discharge the cooler molten fluid into the hot spot of the molten fluid.

23. The method of claim 22 wherein said pump operates intermittently.

24. The method of claim 13 wherein said pump operates continuously.

25. The method of claim 22 comprising placing a temperature sensor near said wire entry location and connecting said temperature sensor to a controller, wherein a desired temperature range is programmed into said controller and said controller activates the pump to discharge the cooler molten fluid into the hot spot when the temperature sensor senses a temperature outside the desired temperature range.

26. The method of claim 25 wherein the controller deactivates the pump when the temperature sensor senses a temperature in the desired temperature range.

27. The method of claim 13 wherein said elongated conduit includes an inlet near the cooler molten fluid and a body of said pump is disposed near said wire entry location.

28. A system for treating wire, comprising:

an elongated vessel that contains a molten fluid;

a pump disposed in the molten fluid in said vessel, wherein said pump includes an elongated conduit extending for at least a portion of the length of said vessel, said elongated conduit extending between a location of cooler molten fluid in said vessel and a location near an entry location of hot wire in the molten fluid of said vessel;

conveyance structure that enables the wire to be conveyed through the molten fluid, wherein the wire is heat treated as a result of passing through the molten fluid; and a temperature sensor in the molten fluid and a controller connected to said temperature sensor, wherein a temperature is programmed into said controller and said controller is adapted to activate the pump to pump the molten fluid when the temperature sensor senses a different temperature so as to change the temperature of the molten fluid.

29. The system of claim 28 wherein the controller is adapted to deactivate the pump when the temperature returns to said programmed temperature.

* * * * *